US006234059B1

(12) United States Patent
Fuchs et al.

(10) Patent No.: US 6,234,059 B1
(45) Date of Patent: May 22, 2001

(54) PISTOL INCLUDING A REMOVABLE STRUCTURAL UNIT

(75) Inventors: Rudolf Fuchs, Thayngen (CH); Michael Osterrath, Jestetten (DE)

(73) Assignee: SIG Arms International AG, Neuhausen am Rheinfall (CH)

( * ) Notice: Subject to any disclaimer, the term of this patent is extended or adjusted under 35 U.S.C. 154(b) by 0 days.

(21) Appl. No.: 09/255,725

(22) Filed: Feb. 23, 1999

(51) Int. Cl.[7] ..... F41A 5/00; F41C 5/00
(52) U.S. Cl. ..... 89/196; 89/195
(58) Field of Search ..... 89/196, 195, 194, 89/197; 42/75.01

(56) References Cited

U.S. PATENT DOCUMENTS

| | | | | |
|---|---|---|---|---|
| 4,602,450 | * | 7/1986 | Hoenig | 42/75.02 |
| 4,709,497 | * | 12/1987 | Resca | 42/75.02 |
| 4,825,744 | * | 5/1989 | Glock | 89/145 |
| 5,309,815 | | 5/1994 | Möller et al. . | |
| 5,406,731 | * | 4/1995 | Stevens | 42/71.02 |
| 5,586,545 | * | 12/1996 | McCaslin | 124/73 |
| 5,669,169 | | 9/1997 | Schmitter et al. | 358/298 |

FOREIGN PATENT DOCUMENTS

| | | |
|---|---|---|
| 365866 | 12/1922 | (DE) . |
| 0 979 986 | 2/2000 | (EP) . |
| 2 380 526 | 9/1978 | (FR) . |
| 29279 | 7/1912 | (GB) . |
| 465941 | 4/1937 | (GB) . |
| 97/29337 | 8/1997 | (WO) . |

* cited by examiner

*Primary Examiner*—Charles T. Jordan
*Assistant Examiner*—Judith A. Nelson
(74) *Attorney, Agent, or Firm*—Venable; Gabor J. Kelemen

(57) ABSTRACT

A pistol includes a cross-sectionally U-shaped frame which has first and second opposite side walls, a formed-on grip, a formed-on trigger guard, a first through bore provided in the first side wall and a second through bore provided in the second side wall in alignment with the first through bore. A structural unit is removably accommodated in the frame above the trigger guard and includes bilateral guide rails and a through aperture aligned with the first and second through bores. The structural unit is received in the frame with a form fit for preventing longitudinal displacements of the structural unit relative to the frame. A removable pin passes through the first and second through bores and the through aperture in the structural unit for removably securing the structural unit to the frame. A slide is received in the frame for forward and rearward reciprocating motions relative to the frame. The rails of the structural unit cooperate with the slide for guiding the slide during its reciprocating motions. A pistol barrel is displaceably received in the slide, and a barrel guiding arrangement guides the barrel in the slide. A closing spring is received in the frame underneath the barrel for urging the slide in a forward direction.

16 Claims, 2 Drawing Sheets

PISTOL INCLUDING A REMOVABLE STRUCTURAL UNIT

BACKGROUND OF THE INVENTION

U.S. Pat. No. 5,669,169 discloses a pistol having a cross-sectionally U-shaped frame which is made of a plastic material and which includes a formed-on grip and trigger guard. The pistol further includes two inserts positioned in the front and the rear of the frame. Both inserts have lateral guide rails for guiding the longitudinally displaceable slide. The inserts are, immediately after an injection molding of the frame, inserted into the frame when the latter is still warm. As a result, the frame shrinks onto the inserts and thus the frame and the inserts become an inseparable unit.

SUMMARY OF THE INVENTION

It is an object of the invention to provide an improved pistol of the above-outlined type which is simple to service.

This object and others to become apparent as the specification progresses, are accomplished by the invention, according to which, briefly stated, the pistol includes a cross-sectionally U-shaped frame which has first and second opposite side walls, a formed-on grip, a formed-on trigger guard, a first through bore provided in the first side wall and a second through bore provided in the second side wall in alignment with the first through bore. A structural unit is removably accommodated in the frame above the trigger guard and includes bilateral guide rails and a through aperture aligned with the first and second through bores. The structural unit is received in the frame with a form fit for preventing longitudinal displacements of the structural unit relative to the frame. A removable pin passes through the first and second through bores and the through aperture of the structural unit for removably securing the structural unit to the frame. A slide is received in the frame for forward and rearward reciprocating motions relative to the frame. The rails of the structural unit cooperate with the slide for guiding the slide during its reciprocating motions. A pistol barrel is displaceably received in the slide, and a barrel guiding arrangement guides the barrel in the slide. A closing spring is received in the frame underneath the barrel for urging the slide in a forward direction.

DESCRIPTION OF THE PREFERRED EMBODIMENT

Figure 1:
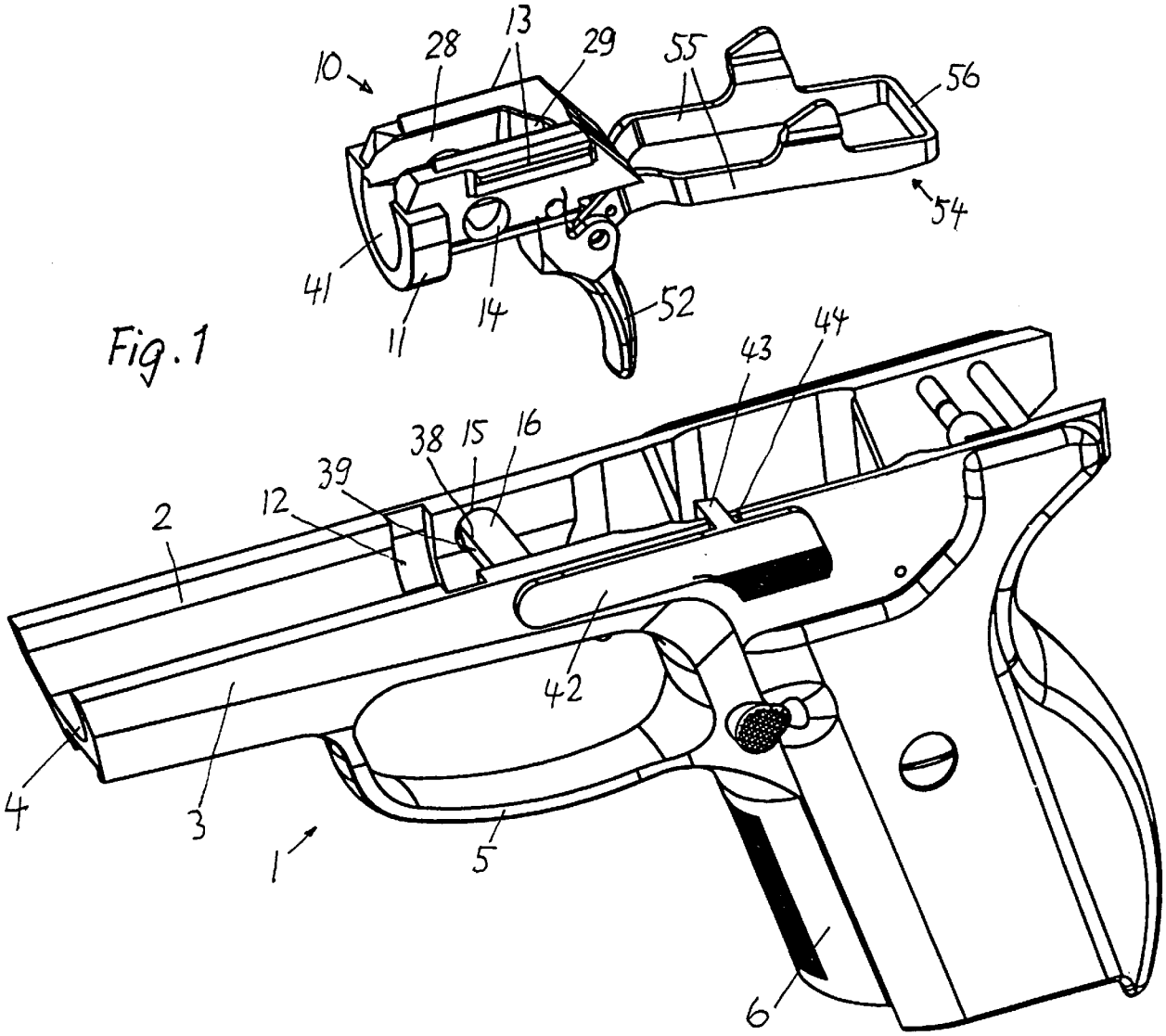
FIG. 1 is an exploded perspective view of two components of the pistol incorporating the invention.
Figure 2:
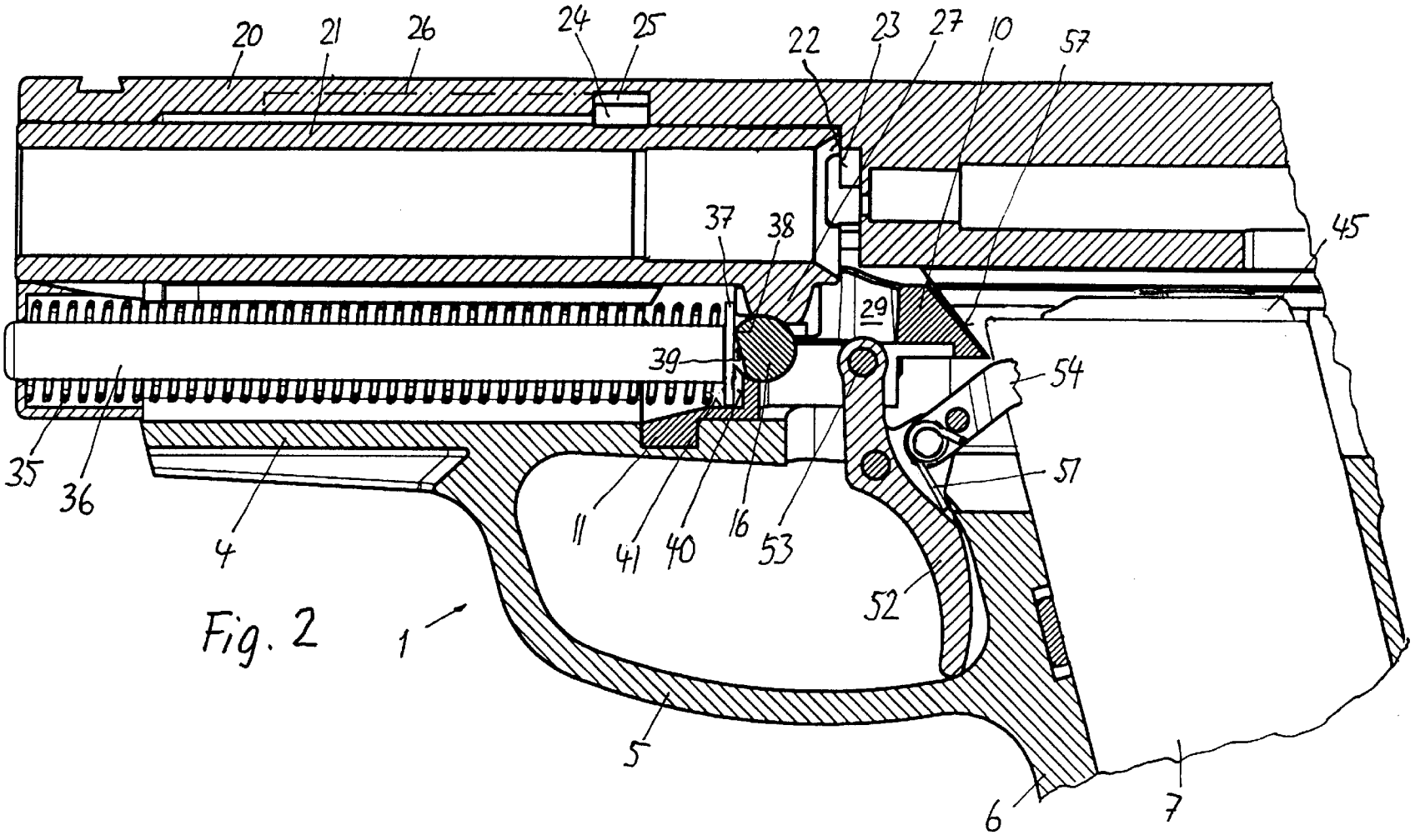
FIG. 2 is a sectional side elevational view of the pistol incorporating the invention.

Turning to FIGS. 1 and 2, the pistol illustrated therein includes a cross-sectionally U-shaped frame 1 made of a thermoplast or an aluminum alloy and has two side walls 2 and 3 as well as a bottom 4. A trigger guard 5 and a grip 6 are formed on the frame 1. The grip 6 defines a magazine well to receive therein a magazine 7. A structural unit 10 made of steel is inserted from above into the frame 1 and has a U-shaped transverse flange 11 which extends with a form fit into a corresponding transverse groove 12 formed in the frame 1. The unit 10 has, at the top, bilateral guide rails 13 for longitudinally guiding a forwardly and rearwardly reciprocating slide 20. The unit 10 further has a transverse bore 14 which, in the inserted state of the unit 10, is in alignment with transverse bores 15 (only one is visible) passing through the two side walls 2, 3 of the frame 1. A pin 16 is inserted into the bores 14, 15 to thus secure the unit 10 to the frame 1.

A barrel 21 is axially displaceably supported in the slide 20. In the closed (forward) position of the slide 20 a shoulder 22 of the slide 20 abuts against the rearwardly oriented end face 23 of the barrel 21. On the barrel 21 two circumferentially offset locking lugs 24 are formed which, in the locking position, extend into corresponding circumferential grooves 25 of the slide 20. In the circumferential direction, slightly beyond the drawing plane of FIG. 2, the circumferential grooves 25 change into longitudinal grooves 26 shown in a dash-dot line in FIG. 2. At the lower side the barrel 21 has, at its rearward end, a follower lug 27 which extends into a control groove (cam track) 28 of the unit 10. The control groove 28 has, at is rearward end, a portion 29 which extends helically, or, in the alternative, obliquely to the barrel axis. When the slide 20 recoils after firing, the follower lug 27 runs onto the portion 29 and rotates the barrel 21, thereby rotating the lugs 24 out of the grooves 25 and into the longitudinal grooves 26, thus unlocking the slide 20. The barrel 21 then remains stationary while the slide 20 continues its rearward recoil motion.

In the frame 1, underneath the barrel 21, a slide closing spring 35 and a closing spring bar 36 extending coaxially within the closing spring 35 are arranged. At its rearward end the bar 36 has a collar 37 which is supported on an edge 38 of a flattened portion 39 of the transverse pin 16. In the removed (disassembled) state of the pin 16 the collar 37 engages the bottom 40 of a forwardly flaring conical depression 41. The bore 14 intersects the bottom 40. In the front the spring 35 is supported on the slide 20. By virtue of the support of the collar 37 on the edge 38 the spring force exerts a clockwise torque on the pin 16 as viewed in FIG. 2.

To one end of the pin 16 a slide catch lever 42 is affixed which is arranged externally on the side wall 3 of the frame 1. A catch lug 43 is secured to the lever 42 spaced from the pin 16. The catch lug 43 extends from the lever 42 into the frame 1 through a notch 44 provided in the frame side wall 3. The catch lug 43 is pressed into the notch 44 by the force of the spring 35. When the magazine 7 is empty, a cartridge feeder 45 of the magazine 7 presses on that portion of the catch lug 43 which projects into the frame 1 from the side wall 3. The catch lug 43 is, as a result, pressed upwardly into engagement with a non-illustrated detent notch of the slide 20, whereby the slide 20 is held in its open (retracted) position.

The pin 16 is chamfered at its free end to be able to insert it through the bore holes 14 and 15 when the spring 35 is in an installed state. The pin 16 also serves as an abutment for the follower lug 27 in the forward direction of motion.

The trigger 52 is pivotally supported on a transverse pin 53 in the structural unit 10 and is urged forwardly into the basic position by a spring 51. To the trigger 52 a trigger rail 54 is articulated which straddles the magazine 7 with two legs 55 and actuates a non-illustrated firing mechanism with a web 56 which interconnects the trigger rail legs 55. The structural unit 10 has, at its rearward end, an obliquely and downwardly extending, run-up surface 57 (which may be cylindrical) for guiding the cartridges during their insertion by the forwardly moving slide 20 into the chamber of the pistol barrel 21.

For disassembling the pistol, the slide 20 is retracted and the unit formed of the lever 42, the pin 16 and the catch lug 43 is pulled out of the frame 1. Thereafter, the slide 20 is, together with the barrel 21, pulled off the frame 1 in the forward direction. The spring 35 is, together with the bar 36, removed and the structural unit 10, together with the trigger 52 and the trigger rail 54 may be lifted out of the frame 1. All the individual components are easy to service. The barrel 21 may be easily replaced, for example, by a different barrel 21 which, for example, has the same outer dimensions but has a different caliber and/or a different chamber for firing other types of ammunition. That part of the rotary bolt which is exposed to wear, namely, the follower lug 27, is formed on the barrel and may thus be renewed by placing the barrel after a certain number of shots are fired. In contrast, in conventional rotary bolts the follower lug is formed in the frame and the corresponding control groove is provided in the barrel. The rotary bolt has the advantage that the barrel does not execute a tilting motion to provide a release thereof and, as a result, the extent of shocks to the pistol during firing is reduced. The pin 16 has the four-fold function of securing the unit to the frame 1, limiting the motion of the barrel 21 and thus the motion of the slide 20 in the forward direction, biasing the lever 42 downwardly and supporting the closing spring 35. Because of such multiple function less individual components are required. The additional function of the pin 16 for biasing the catch lever 42 downwardly has the advantage that no separate spring for such a function is required and further, that the torque exerted on the catch lever 42 downwardly during the rearward point of reversal of the slide 20 is the greatest which increases the functional reliability of the catch lever 42.

It will be understood that the above description of the present invention is susceptible to various modifications, changes and adaptations, and the same are intended to be comprehended within the meaning and range of equivalents of the appended claims.

What is claimed is:

1. A pistol comprising (a) a cross-sectionally U-shaped frame including first and second opposite side walls, a formed-on grip, a formed-on trigger guard, a first through bore provided in said first side wall and a second through bore provided in said second side wall in alignment with said first through bore;

(b) a structural unit removably accommodated in said frame above said trigger guard and including bilateral guide rails and a through aperture aligned with said first and second through bores;

(c) form-fitting means for preventing longitudinal displacements of said structural unit relative to said frame;

(d) a removable pin passing through said first and second bores and said aperture for removably securing said structural unit to said frame;

(e) a slide received in said frame for forward and rearward reciprocating motions relative to said frame; said rails of said structural unit cooperating with said slide for guiding said slide in said reciprocating motions thereof;

(f) a pistol barrel displaceably received in said slide;

(g) barrel guiding means for guiding said barrel in said slide;

(h) a closing spring received in said frame underneath said barrel for urging said slide in a forward direction; and (i) rotary barrel locking means including a locking lug formed on said barrel and a bayonet groove formed in said slide; said locking lug projecting into said bayonet groove.

2. A pistol comprising (a) a cross-sectionally U-shaped frame including first and second opposite side walls, a formed-on grip defining a well, a formed-on trigger guard, a first through bore provided in said first side wall and a second through bore provided in said second side wall in alignment with said first through bore;

(b) a structural unit removably accommodated in said frame above said trigger guard and including bilateral guide rails and a through aperture aligned with said first and second through bores;

(c) form-fitting means for preventing longitudinal displacements of said structural unit relative to said frame;

(d) a removable pin passing through said first and second bores and said aperture for removably securing said structural unit to said frame;

(e) a slide received in said frame for forward and rearward reciprocating motions relative to said frame; said rails of said structural unit cooperating with said slide for guiding said slide in said reciprocating motions thereof;

(f) a pistol barrel displaceably received in said slide;

(g) barrel guiding means for guiding said barrel in said slide;

(h) a closing spring received in said frame underneath said barrel for urging said slide in a forward direction;

(i) a magazine accommodated in said well; said magazine having a spring-loaded feeder for urging cartridges, contained in said magazine, outwardly from said magazine;

(j) a catch lever situated externally of said frame on one of said side walls thereof; said pin being affixed to said catch lever; and (k) a catch lug affixed to said catch lever spaced from said pin; said catch lug cooperating with said slide and said spring-loaded feeder such that in an empty condition of said magazine said spring-loaded feeder urges said catch lug against said slide for arresting said slide in a retracted position thereof.

3. The pistol as defined in claim 2, wherein said form-fitting means comprises a U-shaped flange formed on said structural unit and a complemental groove provided in said frame; said flange being form-fittingly received by said complemental groove.

4. The pistol as defined in claim 2, wherein said structural unit has a rearward portion having a rearwardly and downwardly sloping surface serving as a ramp for guiding cartridges into said barrel by said slide during forward motion thereof.

5. A pistol comprising (a) a cross-sectionally U-shaped frame including first and second opposite side walls, a formed-on grip, a formed-on trigger guard, a first through bore provided in said first side wall and a second through bore provided in said second side wall in alignment with said first through bore;

(b) a structural unit removably accommodated in said frame above said trigger guard and including (1) bilateral guide rails;

(2) a through aperture aligned with said first and second through bores;

(3) a carrier body;

(4) a trigger pivotally supported by said carrier body; and (5) a trigger rail articulated to said trigger to be moved by said trigger;

(c) form-fitting means for preventing longitudinal displacements of said structural unit relative to said frame;

(d) a removable pin passing through said first and second bores and said aperture for removably securing said structural unit to said frame;

(e) a slide received in said frame for forward and rearward reciprocating motions relative to said frame; said rails of said structural unit cooperating with said slide for guiding said slide in said reciprocating motions thereof;

(f) a pistol barrel displaceably received in said slide;

(g) barrel guiding means for guiding said barrel in said slide; and (h) a closing spring received in said frame underneath said barrel for urging said slide in a forward direction.

6. The pistol as defined in claim 5, wherein said form-fitting means comprises a U-shaped flange formed on said structural unit and a complemental groove provided in said frame; said flange being form-fittingly received by said complemental groove.

7. The pistol as defined in claim 5, wherein said structural unit has a rearward portion having a rearwardly and downwardly sloping surface serving as a ramp for guiding cartridges into said barrel by said slide during forward motion thereof.

8. A pistol comprising (a) a cross-sectionally U-shaped frame including first and second opposite side walls, a formed-on grip, a formed-on trigger guard, a first through bore provided in said first side wall and a second through bore provided in said second side wall in alignment with said first through bore;

(b) a structural unit removably accommodated in said frame above said trigger guard and including bilateral guide rails and a through aperture aligned with said first and second through bores;

(c) form-fitting means for preventing longitudinal displacements of said structural unit relative to said frame;

(d) a removable pin passing through said first and second bores and said aperture for removably securing said structural unit to said frame;

(e) a slide received in said frame for forward and rearward reciprocating motions relative to said frame; said rails of said structural unit cooperating with said slide for guiding said slide in said reciprocating motions thereof;

(f) a pistol barrel displaceably received in said slide;

(g) barrel guiding means for guiding said barrel in said slide; said barrel guiding means including a follower lug formed on said barrel and a helical guiding groove; said follower lug projecting into said guiding groove; and (h) a closing spring received in said frame underneath said barrel for urging said slide in a forward direction.

9. The pistol as defined in claim 8, wherein said form-fitting means comprises a U-shaped flange formed on said structural unit and a complemental groove provided in said frame; said flange being form-fittingly received by said complemental groove.

10. The pistol as defined in claim 8, wherein said structural unit has a rearward portion having a rearwardly and downwardly sloping surface serving as a ramp for guiding cartridges into said barrel by said slide during forward motion thereof.

11. The pistol as defined in claim 8, further wherein said pin and said follower lug are arranged relatively to one another such that said follower lug is prevented from forward displacements.

12. The pistol as defined in claim 2, further comprising a closing spring bar counter supporting said closing spring; said closing spring bar being counter supported by said pin at a location of contact between the bar and said pin; said pin having, at said location of contact, an out-of-round cross section such that said catch lever is biased by said closing spring away from a catching position relative to said slide.

13. The pistol as defined in claim 12, wherein said pin has a forwardly-oriented flattened portion.

14. The pistol as defined in claim 12, wherein said structural unit has a supporting face counter supporting said bar when said pin is absent.

15. The pistol as defined in claim 1, wherein said form-fitting means comprises a U-shaped flange formed on said structural unit and a complemental groove provided in said frame; said flange being form-fittingly received by said complemental groove.

16. The pistol as defined in claim 1, wherein said structural unit has a rearward portion having a rearwardly and downwardly sloping surface serving as a ramp for guiding cartridges into said barrel by said slide during forward motion thereof.

* * * * *